US009476272B2

(12) United States Patent
Carisella et al.

(10) Patent No.: US 9,476,272 B2
(45) Date of Patent: Oct. 25, 2016

(54) PRESSURE SETTING TOOL AND METHOD OF USE

(71) Applicant: Neo Products, LLC, Harahan, LA (US)

(72) Inventors: James V. Carisella, Harahan, LA (US); Kevin M. Morrill, Harahan, LA (US); Jay M. Lefort, Harahan, LA (US)

(73) Assignee: Neo Products, LLC., Harahan, LA (US)

( * ) Notice: Subject to any disclaimer, the term of this patent is extended or adjusted under 35 U.S.C. 154(b) by 0 days.

(21) Appl. No.: 14/567,795

(22) Filed: Dec. 11, 2014

(65) Prior Publication Data

US 2016/0168936 A1 Jun. 16, 2016

(51) Int. Cl.
*E21B 23/01* (2006.01)
*E21B 23/06* (2006.01)

(52) U.S. Cl.
CPC ..... *E21B 23/01* (2013.01); *E21B 23/06* (2013.01)

(58) Field of Classification Search
CPC ..... E21B 23/01; E21B 23/06; E21B 23/04
See application file for complete search history.

(56) References Cited

U.S. PATENT DOCUMENTS 3,125,162 A * 3/1964 Briggs, Jr. et al. ..... E21B 23/06 166/123
3,186,485 A * 6/1965 Owen ..... E21B 23/065 166/122
3,294,171 A * 12/1966 Kelley ..... E21B 33/1295 166/120
5,033,549 A 7/1991 Champeaux et al.
5,052,489 A 10/1991 Carisella et al.
5,070,788 A 12/1991 Carisella et al.
5,115,860 A 5/1992 Champeaux et al.
5,115,865 A 5/1992 Carisella et al.
5,159,145 A 10/1992 Carisella et al.
5,159,146 A 10/1992 Carisella et al.
5,392,856 A 2/1995 Broussard, Jr. et al.
5,417,289 A 5/1995 Carisella (Continued)

OTHER PUBLICATIONS

Thru-Tubing Systems, Inc. "Wireline Products Catalog", Revised Feb. 12, 2014, 44 pages.

(Continued)

*Primary Examiner* — Matthew R Buck
*Assistant Examiner* — Aaron Lembo
(74) *Attorney, Agent, or Firm* — JL Salazar Law Firm

(57) ABSTRACT

A non-explosive, down hole, setting tool, system method includes a hydraulic fluid reservoir, a first compressible fluid for applying a first force against hydraulic fluid in contact with one side of a setting piston that is movable in the tool, and a second compressible fluid for applying a second force greater than the first force against the other side of the setting piston. Hydraulic fluid is pumped against one end of the setting piston to overcome the second force and move the setting piston. A reset valve is located in a hydraulic fluid return passageway that is connected between other end of the setting piston and the source of hydraulic fluid. The reset valve can move to selectively block the flow of the hydraulic fluid or allow hydraulic fluid to flow through the fluid return passageway, so that the setting piston can move the setting piston back to its start position.

The tool can be calibrated by running the tool at a first predetermined voltage, automatically shutting off the tool when applied voltage exceeds a second predetermined voltage higher than the first predetermined voltage, and automatically restarting the tool after it is shut off when the voltage reaches a third predetermined voltage lower than the second predetermined level.

28 Claims, 5 Drawing Sheets

(56) References Cited

U.S. PATENT DOCUMENTS

| | | | | |
|---|---|---|---|---|
| 5,469,919 | A | 11/1995 | Carisella | |
| 5,495,892 | A | 3/1996 | Carisella | |
| 5,564,504 | A | 10/1996 | Carisella | |
| 5,813,459 | A | 9/1998 | Carisella | |
| 5,975,205 | A | 11/1999 | Carisella | |
| 6,145,598 | A | 11/2000 | Carisella | |
| 6,158,506 | A | 12/2000 | Carisella | |
| 6,164,375 | A | 12/2000 | Carisella | |
| 6,202,748 | B1 | 3/2001 | Carisella et al. | |
| 6,213,217 | B1 | 4/2001 | Wilson et al. | |
| 6,223,820 | B1 | 5/2001 | Carisella | |
| 6,305,477 | B1 | 10/2001 | Carisella et al. | |
| 6,311,778 | B1 | 11/2001 | Carisella et al. | |
| 6,318,461 | B1 | 11/2001 | Carisella | |
| 6,341,654 | B1 | 1/2002 | Wilson et al. | |
| 6,345,669 | B1 | 2/2002 | Buyers et al. | |
| 6,354,372 | B1 | 3/2002 | Carisella et al. | |
| 6,374,917 | B2 | 4/2002 | Carisella | |
| 6,458,233 | B2 | 10/2002 | Carisella | |
| 6,543,541 | B2 | 4/2003 | Buyers et al. | |
| 7,000,705 | B2 | 2/2006 | Buyers et al. | |
| 7,614,454 | B2 | 11/2009 | Buyers et al. | |
| 7,703,511 | B2 | 4/2010 | Buyers et al. | |
| 7,779,905 | B2 | 8/2010 | Carisella et al. | |
| 8,025,105 | B2 | 9/2011 | Templeton et al. | |
| 8,191,645 | B2 | 6/2012 | Carisella et al. | |
| 8,534,367 | B2 * | 9/2013 | Carisella | E21B 23/04 166/102 |
| 8,813,841 | B2 | 8/2014 | Carisella | |
| 9,080,405 | B2 | 7/2015 | Carisella | |
| 2001/0027868 | A1 | 10/2001 | Carisella | |
| 2001/0035252 | A1 | 11/2001 | Carisella | |
| 2007/0012435 | A1 * | 1/2007 | Obrejanu | E21B 23/00 166/66.7 |
| 2008/0202771 | A1 | 8/2008 | Carisella et al. | |
| 2009/0095466 | A1 * | 4/2009 | Obrejanu | E21B 23/00 166/98 |
| 2010/0314135 | A1 | 12/2010 | Carisella et al. | |
| 2011/0259607 | A1 | 10/2011 | Carisella | |
| 2012/0160483 | A1 | 6/2012 | Carisella | |
| 2013/0327544 | A1 | 12/2013 | Carisella | |
| 2014/0326465 | A1 | 11/2014 | Carisella | |

OTHER PUBLICATIONS

HPI, Chapter 2, "Tubing & Thru-Tubing Bridge Plugs", High Pressure Integrity, Inc., 2008 Weatherford, 35 pages.

HPI, Chapter 3, "Bailer Systems", High Pressure Integrity, Inc., 2008 Weatherford, 44 pages.

* cited by examiner

PRESSURE SETTING TOOL AND METHOD OF USE

TECHNICAL FIELD

This invention relates to a non-explosive setting tool for use in a wellbore, and a method of using such a setting tool.

BACKGROUND OF THE INVENTION

Down hole tools for use in oil and gas wells are carried into the casing of a subterranean on a conduit, such as wire line, electric line, continuous coiled tubing, threaded work string, or the like. These tools include devices such as expandable elastomeric, permanent or retrievable plugs, packers, ball-type and other valves, injectors, perforating guns, tubing and casing hangers, cement plug dropping heads, and other devices typically used during the drilling, completion, or remediation of a subterranean well. Such devices and tools will hereafter be called "auxiliary tools."

An auxiliary tool is typically set and anchored into position within the casing such that movements in various directions such as upwardly, downwardly, or rotationally, are resisted, and, in fact, prevented. Such movements may occur as a result of a number of causes, such as pressure differentials across the tool, temperature variances, tubing or other conduit manipulation subsequent to setting for activation of other tools in the well, and the like.

When positioned at the required depth, the auxiliary tool must be set. This typically requires shearing locating pins, setting a "slip" mechanism that engages and locks the auxiliary tool with the casing, and energizing the packing element in the case of setting a plug. This requires large forces, often in excess of 50,000 lbs. Setting an auxiliary tools often is often achieved by using an apparatus, such as a "setting tool," which may be introduced into the well along with or subsequent to the auxiliary tool on wire or electric line, continuous or coiled tubing, or by other known means.

Many types of setting tools exist. Some of these setting tools are known to apply hydrostatic well pressure within well fluids at the setting or activating depth through the setting apparatus and upon a face of a piston head or the like to move a stroking rod, cylinder or housing member in a direction to activate manipulation of the setting tool. Likewise, some of these setting tools are hydraulically operated, either by use of a pump in the setting tool that develops hydraulic pressure or surface pumps that transmit hydraulic pressure through tubing to the setting tool.

However, the most commonly used setting tools are those that are activated by means of an explosive called a pyrotechnic or "black power" charge to cause an explosion within a portion of the housing of the manipulation tool in order to create to drive a piston, stroking rod, or other member to cause the manipulation of the auxiliary tool. By "explosion" it is meant the continuous generation, sometimes relatively slowly, of energy by electric activation of a power charge-initiated reaction, which results in a build up within a chamber of transmittable gaseous pressure within the apparatus.

After the auxiliary tool is set, the explosive setting tool remains pressurized and must be raised to the surface and depressurized so that it can be used again. This typically entails bleeding pressure off the setting tool by rupturing a piercing disk with a piercing screw, thus creating a vent hole that allows the gas within the setting tool to bleed off. Not only is the depressurization of the setting tool dangerous, but it also exposes workers to potentially hazardous chemicals that result from the combustion of the pyrotechnic. Thus, this operation must be carried out under strictly controlled conditions.

While many procedures have been developed to minimize the risks associated with an explosive setting tool, many disadvantages inherent in the use of an explosive setting tool still remain. Explosives are dangerous to handle and difficult to store and maintain on the job site. This requires the use of trained explosives personnel at every stage of operation. Special permits and licenses are often required to comply with State and local safety regulations.

Additionally, the use of explosives requires the controlled, gradual lowering of the setting tool. Certain of the prior setting tools have included an orifice in the body of the tool through which oil is forced as detonation occurs to thereby slow the setting action on the device being set. Also, explosives which are "slow burning" are employed in order to lessen the undesirable effects of a sudden explosion. Moreover, the use of explosives requires that the firing chamber of the tool be cleaned after every use, thereby adding to the maintenance requirements of the tool.

In order to satisfy the need for a non-explosive setting tool, a developed as an improvement over explosive-type setting tools, which is the subject of U.S. Pat. No. 8,534,367, in which the inventor was one of inventors of the subject invention. This improvement was a non-explosive conversion unit for conventional explosive-type setting tools. In particular, the invention included a conversion assembly that retrofitted a conventional explosive setting tool, by removing the internal pressure cylinders in which the explosive charge was detonated to create a charge of pressurized gas. These components were replaced by a conversion unit that utilized a combination pressurized gas and hydraulic pressure to move a piston to perform the setting operation.

Even though the conversion tool in U.S. Pat. No. 8,634,367 eliminated the need for explosives in a setting tool, there is still a need for a non-explosive setting tool is not a conversion unit for a housing designed for use with explosives, which has built-in limitations. For example, explosive units are restricted to the limited stroke of the setting units that rely on the force applied by the relatively small explosive charge that is used. This stroke is not sufficient for many tools so that a setting tool with a longer stroke is desirable and needed.

Additionally, a retrofitted tool of the type described in U.S. Pat. No. 8,634,367 needs to be partially disassembled after it performs a setting operation and is pulled out of the well, in order to be reset so it can be used again. An automatic reset would be desirable to save time between setting operations.

BRIEF SUMMARY OF THE INVENTION

Generally, a non-explosive, down hole, setting tool, in accordance with the invention has an elongated tool body with a longitudinal bore and having proximal and distal ends, a source of hydraulic fluid in the tool body, a first source of compressible fluid in the tool body configured apply a first force against the hydraulic fluid, a setting piston movable in the longitudinal bore including proximal and distal sides facing the proximal and distal ends of the tool body, respectively, and a second source of compressible fluid in the tool body configured to apply a second force greater than the first force against the distal side of the setting piston, a pump in the tool body configured to pump hydraulic fluid against the proximal end of the setting piston at a third force great enough to overcome the second force and move the setting piston toward the distal end of the setting tool. A hydraulic fluid return passageway is mounted between the proximal end of the setting piston and the source of hydraulic fluid. A reset valve is configured to move between a closed position blocking hydraulic fluid from flowing through the hydraulic fluid return passageway and an open position allowing hydraulic fluid to flow through the fluid return passageway. When the reset valve is in the open position, the second force against the distal end of the setting piston can move the setting piston toward the proximal end of the tool.

Also in accordance with the invention, a non-explosive system for setting an auxiliary down hole tool has an elongated tool body with a longitudinal bore and having proximal and distal ends, a hydraulic fluid reservoir in the tool body, a first gas compression chamber in the tool body for containing pressurized gas and configured to apply a first force against hydraulic fluid in the hydraulic fluid reservoir, a setting piston movable in the longitudinal bore including proximal and distal sides facing the proximal and distal ends of the tool body, respectively, a second gas compression chamber in the tool body for containing pressurized gas and configured to apply a second force greater than the first force against the distal side of the setting piston, and a pump in the tool body configured to pump hydraulic fluid against the proximal end of the setting piston at a third force great enough to overcome the second force and move the setting piston toward the distal end of the tool body. A hydraulic fluid return passageway between the proximal end of the setting piston and the hydraulic fluid reservoir includes a reset valve configured to move between a closed position blocking hydraulic fluid from flowing through the hydraulic fluid return passageway and an open position allowing hydraulic fluid to flow through the fluid return passageway. When when the reset valve is in the open position, the second force against the distal end of the setting piston can move the setting piston toward the proximal end of the tool.

A method for setting an auxiliary down hole tool using a non-explosive setting tool and resetting the setting tool, where the setting tool having a tool body with a longitudinal bore and proximal and distal ends, includes the steps of maintaining hydraulic fluid in a hydraulic fluid reservoir in the tool body at a first predetermined pressure by using pressurized gas in a first gas source to apply a first force against the hydraulic fluid, maintaining gas in a second gas source at a second predetermined pressure greater than the first predetermined pressure to apply a second force against the distal side of a setting piston movable in the longitudinal bore of the setting tool, and pumping hydraulic fluid from the hydraulic fluid reservoir to apply a third force against the proximal side of the setting piston, the third force being great enough to overcome the second force and move the setting piston from a starting position toward the distal end of the setting tool. A hydraulic fluid return passageway between the proximal end of the setting piston and the hydraulic fluid reservoir is blocked with a reset valve to prevent hydraulic fluid from flowing through the hydraulic fluid return passageway when the setting piston is moving toward the distal end of the setting tool. The hydraulic fluid return passageway is opened when the reset valve is reset so that the second predetermined pressure in the second gas source can overcome the first predetermined pressure in the hydraulic fluid reservoir and move the setting piston back to its starting position.

DETAILED DESCRIPTION OF THE INVENTION

As used herein, "a" or "an" means one or more than one. Additionally, the term "distal" refers to the end of an element closest to the bottom of the borehole, e.g., the end facing down hole. The term "proximal" refers to the end of an element closest to the top of her borehole, e.g., the end facing up hole.

The methods and apparatus of the present invention will now be illustrated with reference to FIGS. 1A-1C and FIGS. 2A-C. The drawings are merely illustrative and not exhaustive examples of the scope of the present invention. Variations, which are understood by those having ordinary skill in the art, are within the scope of the present invention.

Figure 1A:
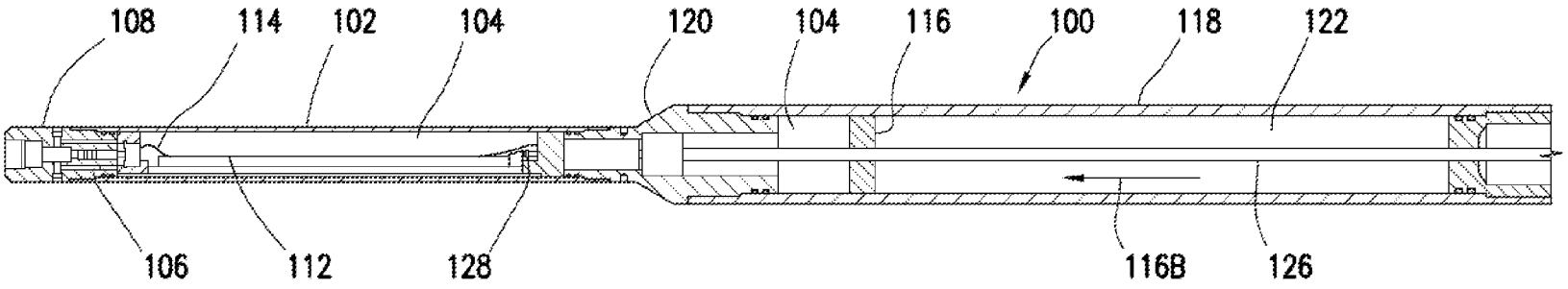
FIGS. 1A-1C schematically depict a non-explosive setting tool designed in accordance with the invention with the components in their respective positions where are ready to be used in a setting operation.
Figure 2A:
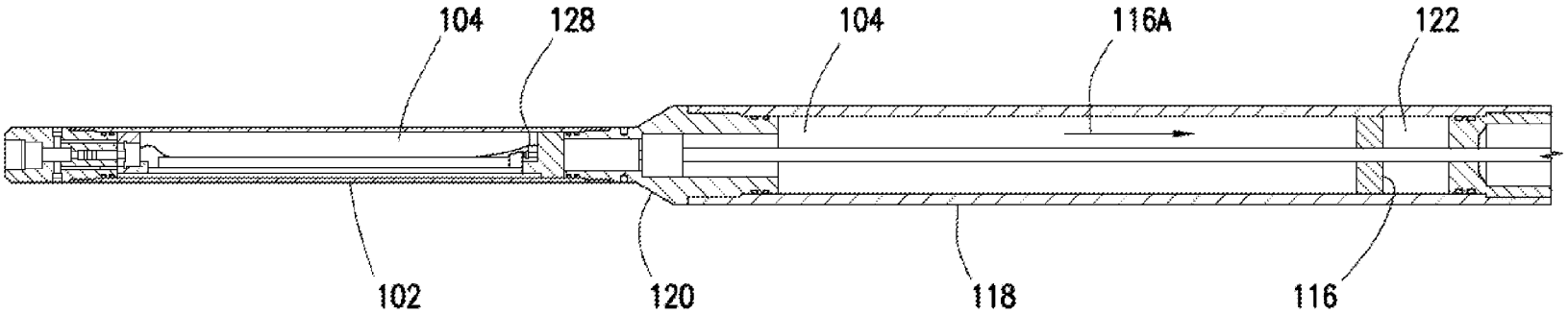
FIG. 2A-2C schematically depict a non-explosive setting tool designed in accordance with the invention with the components in their respective positions after a setting operation has been performed.
Figure 1B:
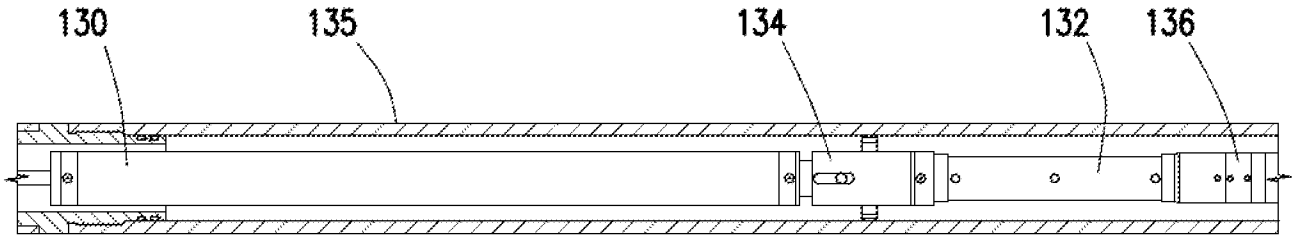
Figure 2B:
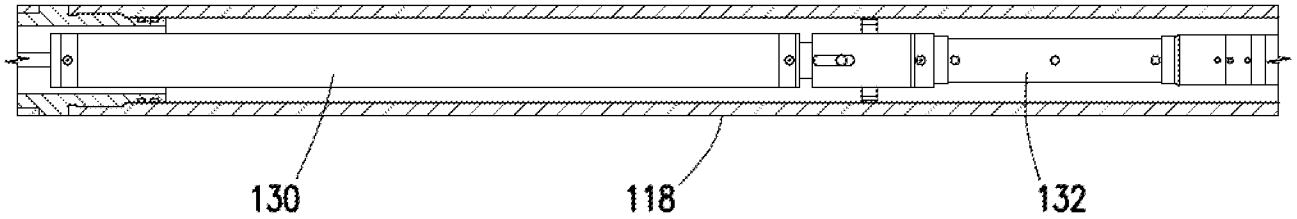
Figure 1C:
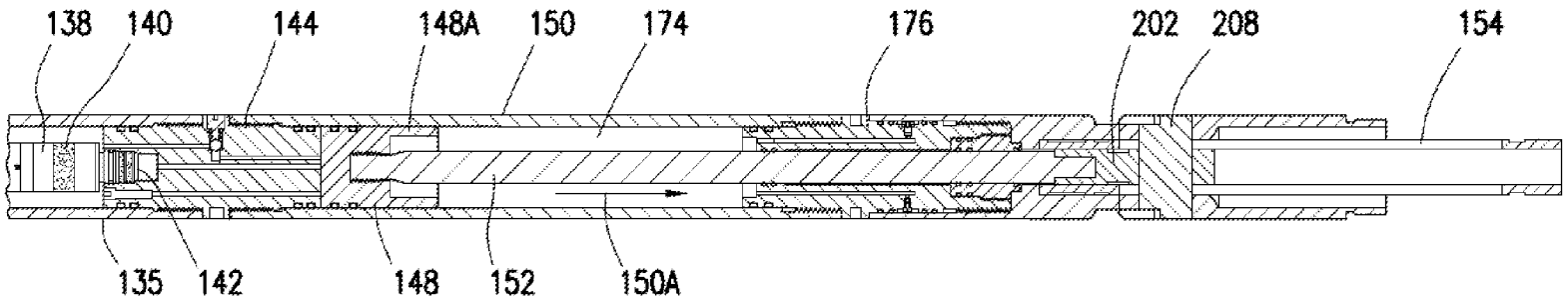
Figure 2C:
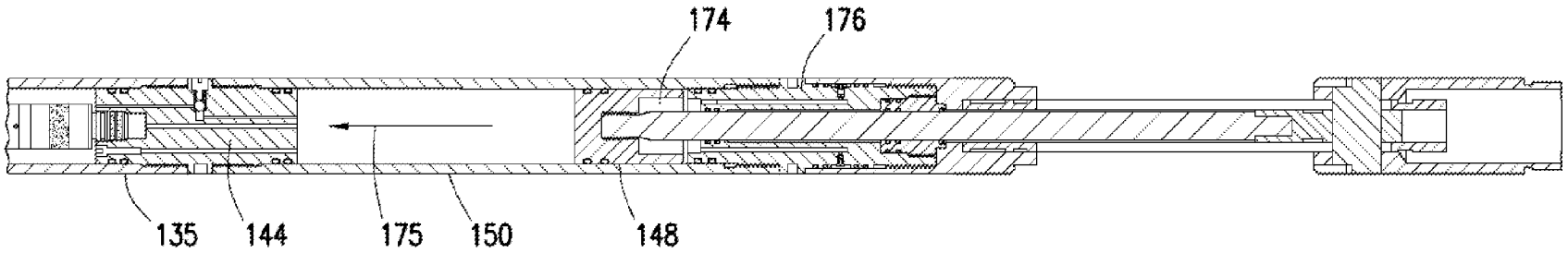

FIGS. 1A-C show an embodiment of the inventive non-explosive down hole setting tool 100 with the components arranged in their respective positions where the tool is set and ready to perform a setting operation, and FIGS. 2A-2C show the components after a setting operation has been performed. The drawings are arranged so that FIGS. 1A and 2A show the proximal section of the tool 100 located at its end facing up hole, FIGS. 1B and 2B show the middle section, and FIGS. 1C and 2C show the distal section located at the end facing down hole. The figures are placed one-above-the-other so that the positions of the tool components in their respective locations before (FIGS. 1A-1C) and after (FIGS. 2A-2C) a setting operation can easily be compared.

Referring to FIG. 1A, an electronics sub 102, which is positioned at the proximal end of the tool 100, includes an upper compression chamber 104, into which pressurized gas can be introduced through a push-to-connect inflation valve 106 mounted in an end cap 108 that is threadedly connected to the electronics sub 102. Any one-way valve, such as a ball check, diaphragm, or swing check valve, could also be used. Preferably, pressurized air can be used in the compression chamber 104, but other compressible fluids such as, for example, nitrogen can also be used. Seals such as rubber O-rings 110 are mounted at the interface between the electronics sub 102 and the end cap 108 to prevent gas from leaking out of the gas compression gas chamber 104.

A printed circuit board ("PCB") 112, or suitable PCB array or other solid-state electronic component, is mounted in the electronics sub 102 and connected to a power source (not shown) through a conductor wire 114. The PCB 112 includes control logic for running components of the tool 100 as described below for performing setting operations. The PCB 112 is also configured to regulate the voltage of electrical current used to operate the components of the setting tool 100 and to prevent power surges, as described in greater detail below.

Gas in the upper compression chamber 104 is pressurized at a relatively low pressure, preferably about 30-60 psi, in order to exert a positive pressure on a floating piston 116 shown in FIG. 1. The floating piston is movably mounted in an upper cylinder 118 between a start position shown in FIG. 1 and an end position shown in FIG. 2 when the tool 100 has completed a setting cycle. The upper cylinder 118 is threadedly connected to the distal end of the electronics sub 102 through a connector sub 120.

The compression chamber 104 extends from the electronics sub 102 into the upper cylinder 118. Seals, such as rubber O-rings, are mounted at the interfaces between the end cap 108, the electronics sub 102, the connector sub 119 and the upper cylinder 118 to prevent pressurized gas from leaking out of the upper compression chamber 104.

Gas pressure in the upper compression chamber 104 provides sufficient force on the floating piston 116 to cause it to move in response to changes in the volume of hydraulic fluid in a hydraulic fluid reservoir 122 located in the upper cylinder 118 below the distal end of the floating piston 116. For example, as hydraulic fluid is pumped from the hydraulic fluid reservoir 122, the volumetric size of the hydraulic fluid reservoir 122 decreases, and the pressurized gas in the compression chamber 104 moves the floating piston 116 from the position shown in FIG. 1A, toward the distal end of the upper cylinder 118, to the position shown in FIG. 2A in direction of arrow 116A in FIG. 2A. As the hydraulic fluid reservoir 122 decreases in volumetric size, the floating piston 116 prevents gas pockets from forming in the hydraulic fluid reservoir 122.

Conversely, as the volumetric size of the hydraulic fluid reservoir increases, such as when the tool is reset as described below, the floating piston 116 will move toward the proximal end of the upper cylinder 118 to the position shown in FIG. 1A, in the direction of arrow 116B in FIG. 1A. The floating piston 116 includes seals, such as rubber O-rings, at its interface with the bore of the upper cylinder 118 to prevent hydraulic fluid from leaking into the compression chamber 104.

A hollow rod 126 is mounted in the upper cylinder 118 to provide a conduit for one or more conductor wires 128 that extend from the PCB 112 to a motor controller 130 of a type known to one skilled in the art, shown in FIG. 1B, which is mounted in a protective flask to protect the electronic components of the controller 130 from hydraulic fluid and elevated down hole temperatures. The rod 126 also operates as a guide for the floating piston 116.

The motor controller 130 is connected to a hydraulic pump motor 132 through a centralizer 134 for maintaining longitudinal alignment of the components in the bore of a hydraulic pump sub 135 that is threadedly connected to the distal end of the upper cylinder 118. Seals such as rubber O-rings are mounted between the upper cylinder 118 and the hydraulic pump sub 135 to prevent hydraulic fluid from leaking out.

The pump motor 132 is connected through a gear box 136 to a hydraulic pump 138, shown in FIG. 1C, which is located at the distal end of the hydraulic motor sub 135. The hydraulic pump 138 includes an inlet 140 that allows low-pressure hydraulic fluid to enter the pump 136 and an outlet 142 that allows high-pressure hydraulic fluid to exit the pump 136. The pump 136 is preferably a positive displacement pump, such as, rotary lobe, progressive cavity, screw, gear, hydraulic or the like which are known.

Figure 3:
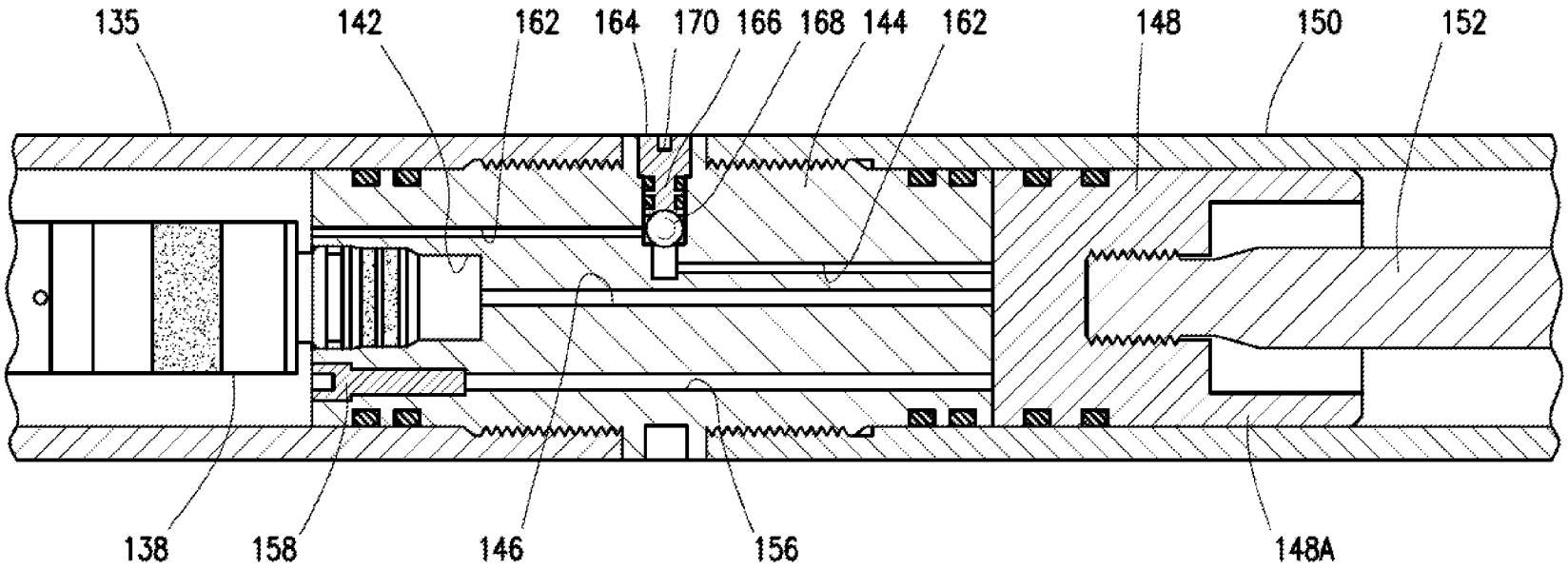
FIG. 3 is an enlarged schematic view the fluid passageway component shown in FIGS. 1C and 2C, which is connected between the hydraulic pump sub and the lower cylinder.

The pump outlet 142 is connected to a fluid passageway component 144, shown in enlarged form in FIG. 3. The fluid passageway component 144 is threadedly connected between the hydraulic pump sub 135 and a lower cylinder 150, with seals such as rubber O-rings between the respective components to prevent leakage of hydraulic fluid. The fluid passageway component 144 includes a pressurized fluid passageway 146 through which hydraulic fluid is pumped from the pump outlet 142, to the proximal face of a piston 148 that is mounted for back-and-forth movement within the bore of the lower cylinder 150, so that the piston 148 can be moved from the position shown in FIG. 1C to the setting position shown in FIG. 2C, in the direction of the arrow 150A shown in FIG. 1C. Seals such as rubber O-rings are mounted between the outlet 142 and the fluid passageway component 144 to prevent fluid leakage.

The distal face of the piston 148 is threadedly connected to a piston rod 152, which in turn is connected to a setting mandrel 154 located at the distal end of the tool 110. The piston 148 is configured to impart sufficient force to the setting mandrel 154 to perform a setting operation for the tool 100, described in greater below. The piston 148 is formed with a circumferential skirt 148A on its distal side so that internal fluid pressure requirements for resetting the tool 100 are kept relatively low to extend the life of the seals, as described in greater detail below.

The fluid passageway component 144 also includes a fluid return passageway 156 through which hydraulic fluid on the proximal side of the piston 148 can return to the hydraulic fluid reservoir 122 when the hydraulic fluid exceeds a predetermined pressure. A pressure relief valve 158 is provided in the fluid return passageway 146 to prevent overpressurization. The pressure relief valve 158 can be any type of one-way valve, such as a ball check, diaphragm, or swing check valve. Seals such as rubber O-rings are provided at the interfaces between the upper and lower cylinders 118 and 150 and the fluid passageway component 144 to prevent hydraulic fluid from leaking out.

The fluid passageway component 144 also includes a reset fluid passageway 162 through which hydraulic fluid can flow back to the hydraulic fluid reservoir 122 for resetting the tool 100 when the setting mandrel 154 is returned from its setting position shown in FIG. 2C, to the start position shown in FIG. 1C. A manually-operable reset valve 164 for regulating the flow of hydraulic fluid in the reset fluid passageway 162 includes a valve stem 166 that is threaded into the fluid passageway sub 144. The valve stem 166 engages a ball stop 168 that blocks hydraulic fluid from flowing through the passageway 162 when the valve stem 166 is in the position shown in FIG. 1C. The valve stem 162 includes a recess 170, which can receive a hex-head driver or other driver of a suitable shape, so that the valve stem 166 can be rotated for unscrewing it and backed out of the connector sub 146 for allowing the ball stop 168 to move, which allows hydraulic fluid to flow through the passageway 166 back to the hydraulic fluid reservoir 122. Seals such as rubber O-rings are mounted on the valve stem 166 to prevent hydraulic fluid from leaking out.

A lower compression chamber 174 is formed in the lower cylinder 150, between the piston 148 and a tandem sub 176 that is threadedly connected to the distal end of the lower cylinder 150. A gas pressure of about 120 psi is preferably maintained in the lower compression chamber 174. Preferably, the compressed gas is air. Alternatively, other compressible gases such as nitrogen can be used.

The gas pressure in the lower compression chamber 174 is substantially higher than the gas pressure in the upper compression chamber 104. This pressure differential can be used to reset the tool 100 by moving the setting mandrel 154 from its extended setting position shown in FIG. 2C, back to the position shown in FIG. 1C, in the direction of the arrow 175 shown in FIG. 2C, as described in greater detail below.

Figure 4:
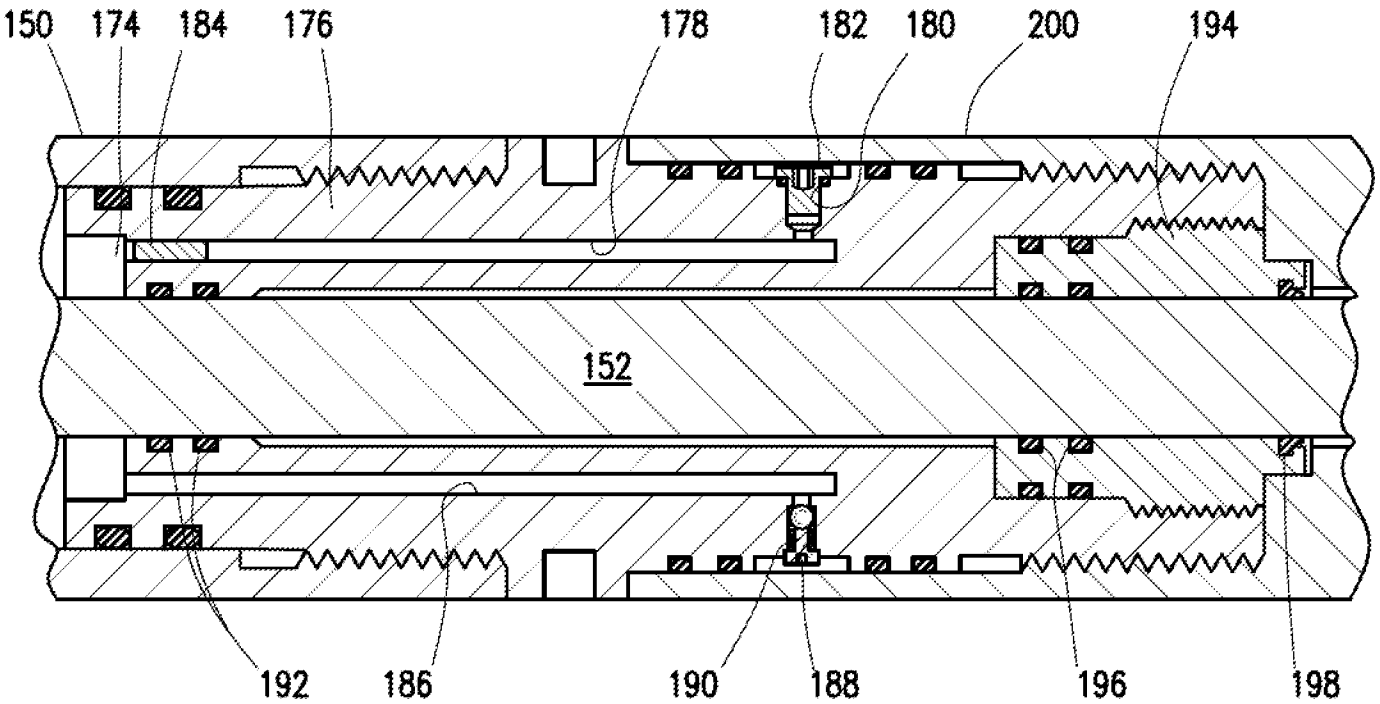
FIG. 4 is an enlarged schematic view the tandem sub shown in FIGS. 1C and 2C, which is connected at the distal end of the lower cylinder.

The tandem sub 176 has a gas inlet passageway 178 through which gas can be charged into the lower compression chamber 174, shown in enlarged view of the tandem sub in FIG. 4. The passageway 178 has an opening 180 that is threaded to receive a gas charging tool. A threaded plug 182 can be used to close and the opening 180 to seal the opening and protect its threads. A one-way check valve 184 is mounted in the inlet passageway 178 for preventing pressurized gas in lower compression chamber 174 from flowing back through the inlet passageway 178. The tandem sub 176 also has a gas outlet passageway 188 through which pressurized gas in the compression chamber 174 can be removed. The passageway 186 has a threaded opening which can sealed with a plug 190.

Seals such as rubber O-rings are mounted between the tandem sub 176 and the lower cylinder 150 to prevent pressurized gas in the lower compressed gas chamber 174 from leaking out. One or more dynamic seals 192 such as rubber O-rings are mounted between the piston rod 152 and the tandem sub 176 to prevent pressurized gas from leaking out as the piston rod 152 moves in the tandem sub 176.

A packing safety nut 194 is threadedly connected to the distal end of the tandem sub 176, which includes one or more dynamic seals 196 such as rubber O-rings between the packing safety nut 194 and the piston rod 152. The packing safety nut 194 also includes a wiper 198 for wiping well bore fluid off the piston rod 152 as it moves.

The dynamic seals 196 in the packing safety nut 194 protect the dynamic seals 192 in the tandem sub 176 by blocking the flow of well bore fluid from contacting the dynamic seals 192. The dynamic seals 196 operate to substantially extend the life of the dynamic seals 192 by insulating the dynamic seals 192 from the corrosive effects of well bore fluid and preventing excessive wear, which in turn reduces operation expenses as the tool can be used for a much greater number of setting cycles before the seals 192 have to be replaced. Instead, it is a much simpler operation and less expensive to remove the packing safety nut 194 and replace the seals 196.

An end cap sleeve 200 is threadedly connected to the distal end of the lower cylinder 150 for preventing well bore fluid from entering the tool 100 if plugs 182 and 188 should fail. The sleeve 202 also engages the distal end of the packing safety nut 194 for holding it in place. Seals such as rubber O-rings are mounted between the inner surface of the sleeve 200 and the tandem sub 176. The piston rod 152 is threadedly connected at its distal end to a connector 202 that is in turn connected through a cross over 208 to the setting mandrel 154.

The tool 100 is designed so that its operation in the field is simple and uncomplicated and requires minimum maintenance throughout a large number of setting operations. An important part of providing a tool with minimum maintenance is to regulate the voltage in the tool so that shutdowns are kept at a minimum. Electric power at the surface is provided by a 300-600 DC power supply. The power supply is connected to the wireline that conveys the tool 100 into and out of the well. The voltage that is supplied at the top of the tool 100 can vary greatly and depends upon the combination of the voltage at the power supply at the top of the well and the resistance of the wireline used to convey the tool into and out of the well. For example, during routine operation of the tool the applied voltage at the power supply can be 200 $V_{dc}$ surface and the voltage at the tool can be 125 $V_{dc}$. Voltage drop in wireline having electrical resistance is a natural phenomenon related to the flow of electric current thru a conductor (the wireline) having electrical resistance. The tool 100 is designed to provide optimal performance when the voltage supplied at the top of the tool is 200-250 $V_{dc}$. Operating the tool at voltages outside of 200-250 $V_{dc}$ can cause damage to the wireline and/or the PCB 112. Damage to the wireline and/or the PCB 112 during tool operation could result in project failure with very costly consequences. The ability to measure and know the magnitude of the applied voltage at the top of the tool would require the use of sophisticated telemetric devices that are attached to the wireline and proximal to the tool. These devices must be compatible with all others devices attached to the wireline and can introduce unwanted operational concerns.

The tool is designed to be "user friendly". Operation of the tool 100 must be simple and uncomplicated to be successful in the field. The PCB 112 is programmed to perform in a way that will indicate when the applied voltage at the tool is at or near the optimal operating voltage. This is done without the use of other devices on the wireline. The PCB 112 monitors the input voltage to the tool 100. It controls the application of electric power to all electronic sub-circuits on the PCB. The PCB 112 preferably includes a programmable multi-functional regulating capability that monitors, regulates, and controls operating voltage and current levels throughout the operation of the tool 100. It regulates the initial electrical startup power applied to the tool 100, it monitors its applied voltage during tool operation and is programmed to shut off power to the tool if the applied voltage reaches and/or exceeds a predetermined "high voltage shutoff" value. This capability is a safety feature that protects the PCB from power surges and also assists in the process of determining the nominal applied input voltage at the tool 100. The PCB 112 is able to restart the tool after a "high voltage shutoff" by means of reducing the voltage at the power supply which will result in reducing the voltage at the PCB 112. The tool 100 will automatically restart once the input voltage at PCB 100 is reduced to a preprogrammed "restart voltage" value.

Instead of having to monitor dials or gauges to maintain operating currents and voltages, the PCB can be programmed to start the tool 100 at a selected "startup voltage" and shut off the tool when the applied voltage exceeds a selected "shutoff voltage", preferably at about 260 $V_{dc}$ at the head of the tool, then setting the running voltage at a level about 10 $V_{dc}$ below the cutoff. During operation, if the voltage regulator shuts off the tool 100, it is set so that the motor will automatically start up again when the voltage at the head of the tool reaches a predetermined level, about 230 $V_{dc}$. The tool can then be operated without worrying about tripping the automatic voltage shut off during normal operations. This relatively simple procedure allows field operators to provide for voltage surge protection with an automatic shutoff that can easily be set and maintained. For example, an operational electric current can easily be set to eliminate the need to continuously monitor current and voltage levels and avoid shutdowns in operation. Because of internal resistances in the hydraulic lines, the electrical resistance across the tool can vary. Therefore the tool 100 is designed to be calibrated by setting a running voltage level that avoids shutdowns.

When the tool 100 has been calibrated and the components are in their respective positions shown in FIGS. 1A-1C, the tool is ready to be run into a well bore to perform a setting operation. Once the tool 100 has been run into the bore hole, control logic in the controller 130 can be activated. The controller 130 is programmed to energize the pump motor 132 and run the hydraulic pump 136 when the PCB is activated, for a set period of time, until all hydraulic fluid is pumped, for a specific stroke length, or until a specific pump outlet pressure is obtained. Further, the pump control logic can be programmed to vary the stroke speed, the stroke pressure, and other timing elements.

Once the hydraulic pump motor 132 is energized, the pump 138 pumps hydraulic fluid under pressure through pump outlet 142 into the fluid passageway 146 and to the proximal face of the piston 148. This exerts a force on the piston 148 that causes it to travel toward the distal end of lower cylinder 140 in the direction of the arrow 150A, shown in FIG. 2C, and compress gas in the lower compression chamber 174. As the piston 148 moves downward toward the distal end of the tool 100, the setting mandrel 154 is moved downward to exert sufficient force to break studs or the like in the tool that is to be set, and impart a setting force to the tool.

An important advantage of the setting tool made in accordance with the invention is that it can operate with a stroke length significantly longer than the stroke length of explosive-type setting tools and non-explosive units that are retro-fitted into the body of an explosive-type setting tool such as the one described in U.S. Pat. No. 8,534,367. These tools are typically limited to a 7" stroke because of the inherent limitations of explosive devices used in the tools and the design of the body of such a tool into which the retro-fitted units are mounted.

For example, 55,000 lb. of force is required to break the studs for setting down hole packers, plugs and sleeves with which setting tools are typically used. An typical explosive charge used with these setting tools can only impart that much force over a 7" inch stroke because of the amount of gas that is discharged when a standard sized explosive charge is detonated. Retro-fitted tools are limited to the same stroke length because of the design of the explosive-type tool body into which the retro-fitted unit is mounted. However, because there are no displacement restrictions on the electro-hydraulic tool of the present invention tool, longer strokes are possible for importing a setting force over a greater distance.

The tool is preferably designed for the setting mandrel 154 to impart about 55,000 lb. of force. This can be done by designing the tool to impart about 80,000 lb. of force, which will overcome about 15,000 lb. of ambient pressure in the well bore at 350° F. and provide a 10,000 lb. buffer.

Once the setting tool 100 has moved to its setting position in the direction or arrow 152 to the position shown in FIG. 2C, and an auxiliary tool has been set, the tool 100 must be removed from the bore hole to be reset. Once raised to the surface, the valve stem 166 is partially unscrewed from the connector sub 148 to allow the ball stop 168 to move and open the reset fluid passageway 162. Once the reset fluid passageway is unblocked, force exerted by gas under pressure in the lower compression chamber 174 will overcome the lower level of force exerted by pressurized gas in the upper compression chamber 104 and move the piston 148 in the direction of the arrow 175 toward the position shown in FIG. 2C.

Movement of the piston 148 in the direction of the arrow 175 causes hydraulic fluid to flow from the space between the proximal face of the piston 148 and the distal end of the connector sub 146 to return through the reset fluid passageway 162 and back into the reservoir 122, causing the floating piston 116 to move back to the position shown in FIG. 1C.

The skirt 148A on the piston 148 allows for the gas pressure in the lower compression chamber 174 to be maintained at a minimum level and still operate to reset the tool as described. This lower compression level reduces damage to the internal seals and increases the life of the seals.

After the tool 100 is reset as described it can be used again without any further servicing simply by screwing the valve stem 166 back into the connector sub 146, which moves the ball stop 168 to block the reset fluid passageway 162. It is estimated that the dynamic seals 196 should be checked and replaced if they show signs of wear about every 10-20 cycles, but that the dynamic seals 192 should not have to be replaced until the tool 100 has been run through at least about 50-100 cycles.

The seals 196 can easily be checked by disconnecting the setting mandrel 154 from the piston rod 152, unscrewing the sleeve 202, and then removing the packing safety nut 194 by unscrewing it from the tandem sub 176. By increasing the number of cycles before seals have to checked and replaced, substantial maintenance costs are eliminated, adding to the simplicity and economic efficiency of the tool 100.

Unlike the explosive-type tools, the inventive tool can be used in non-vertical wells such as those that use horizontal drilling techniques, which have become an accepted drilling practice. In horizontal applications, gas pockets can develop in the hydraulic reservoir, which may result in a setting tool pump becoming gas locked. This situation is avoided with the use of the upper compression chamber 104, which provides a pressurized cushion to minimize the potential of gas pocket formation in the hydraulic fluid reservoir 122 that may lead to a gas lock in the pump 136.

Even though the various subs are shown as being threadedly connected to each other, other connection means, such as weld connections, are also contemplated by the invention.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification.

As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A non-explosive, down hole, setting tool, comprising:

an elongated tool body with a longitudinal bore and having proximal and distal ends;

a source of hydraulic fluid in the tool body;

a first source of compressible fluid in the tool body configured to apply a first force against the hydraulic fluid;

a setting piston movable in the longitudinal bore including proximal and distal sides facing the proximal and distal ends of the tool body, respectively;

a second source of compressible fluid in the tool body configured to apply a second force greater than the first force against the distal side of the setting piston;

a pump in the tool body configured to pump the hydraulic fluid against the proximal side of the setting piston at a third force great enough to overcome the second force and move the setting piston toward the distal end of the setting tool;

a hydraulic fluid return passageway between the proximal side of the setting piston and the source of hydraulic fluid; and a reset valve configured to move between a closed position blocking hydraulic fluid from flowing through the hydraulic fluid return passageway and an open position allowing hydraulic fluid to flow through the fluid return passageway;

wherein the reset valve comprises a valve stem that extends to the outer surface of the tool and is manually operable between closed and open positions for closing and opening the fluid return passageway, respectively;

whereby when the reset valve is in the open position, the second force against the distal side of the setting piston can move the setting piston toward the proximal end of the tool.

2. The non-explosive, down hole, setting tool of claim 1, wherein the source of hydraulic fluid comprises a hydraulic fluid reservoir.

3. The non-explosive, down hole, setting tool of claim 1, wherein the first source of compressible fluid comprises a first gas compression chamber at the proximal end of the tool.

4. The non-explosive, down hole, setting tool of claim 3, further comprising a one-way inflation valve in the first gas compression chamber.

5. The non-explosive, down hole, setting tool of claim 1, further comprising a floating piston movable in the longitudinal bore configured to separate fluid in the first source of compressible fluid and the hydraulic fluid in the source of hydraulic fluid.

6. The non-explosive, down hole, setting tool of claim 1, wherein the pump comprises a controller, a motor, a gear box, a pump inlet for receiving the hydraulic fluid, and a pump outlet for discharging the hydraulic fluid under pressure.

7. The non-explosive, down hole, setting tool of claim 6, further comprising a fluid passageway component between the pump outlet and the proximal side of the setting piston, said component comprising a pressurized passageway between the pump outlet and the proximal side of the setting piston, and a first return fluid passageway between the proximal side of the setting piston and the source of hydraulic fluid, the return fluid passageway further comprising the reset valve for selectively closing and opening the return fluid passageway to the flow of the hydraulic fluid, and a second fluid return passageway between the proximal side of the setting piston and the source of hydraulic fluid including a one way valve configured to open when fluid pressure at the proximal side of the piston exceeds a predetermined pressure.

8. The non-explosive, down hole, setting tool of claim 1, wherein the setting piston further comprises a skirt around the distal side.

9. The non-explosive, down hole, setting tool of claim 1, wherein the second source of compressible fluid comprises a second gas compression chamber at the distal side of the setting piston.

10. The non-explosive, down hole, setting tool of claim 1, further comprising a setting mandrel, a piston rod between the distal side of the setting piston for moving the setting mandrel longitudinally relative to the tool, a tandem sub removably connected to the distal end of the tool comprising at least one first dynamic seal for preventing pressurized gas from leaking between the piston rod and the tandem sub, and a packing nut removably connected at a distal end of the tandem sub comprising at least one second dynamic seal for preventing well bore fluid from leaking between the piston rod and the packing nut.

11. The non-explosive, down hole, setting tool of claim 10, wherein the tandem sub further comprises a fluid passageway for allowing fluid under pressure to be charged into the second source of compressible fluid.

12. The non-explosive, down hole, setting tool of claim 1, further comprising an electronic controller that is programmed to run the tool at a first predetermined voltage, automatically shut off the tool when applied voltage exceeds a second predetermined voltage higher than the first predetermined voltage, and automatically restart the tool after it is shut off when the voltage reaches a third predetermined voltage lower than the second predetermined voltage.

13. The non-explosive, down hole, setting tool of claim 12, wherein the electronic controller is a printed circuit board.

14. The non-explosive, down hole, setting tool of claim 12, wherein the first predetermined voltage is set at about 10 V de at a head of the tool lower than the second predetermined voltage.

15. The non-explosive, down hole, setting tool of claim 12, wherein the second predetermined voltage is set about 260 V de at a head of the tool, and the third predetermined voltage is set at about 230 V de at the head of the tool.

16. A non-explosive system for setting an auxiliary down hole tool, comprising:

an elongated tool body with a longitudinal bore and having proximal and distal ends;

a hydraulic fluid reservoir in the tool body;

a first gas compression chamber in the tool body for containing pressurized gas and configured to apply a first force against hydraulic fluid in the hydraulic fluid reservoir;

a setting piston movable in the longitudinal bore including proximal and distal sides facing the proximal and distal ends of the tool body, respectively;

a second gas compression chamber in the tool body for containing the pressurized gas and configured to apply a second force greater than the first force against the distal side of the setting piston;

a pump in the tool body configured to pump the hydraulic fluid against the proximal side of the setting piston at a third force great enough to overcome the second force and move the setting piston toward the distal end of the tool body;

a hydraulic fluid return passageway between the proximal side of the setting piston and the hydraulic fluid reservoir; and a reset valve configured to move between a closed position blocking the hydraulic fluid from flowing through the hydraulic fluid return passageway and an open position allowing the hydraulic fluid to flow through the fluid return passageway;

whereby when the reset valve is in the open position, the second force against the distal side of the setting piston can move the setting piston toward the proximal end of the tool.

17. The non-explosive system of claim 16, further comprising an electronic controller that is programmed to run the tool at a first predetermined voltage, automatically shut off the tool when applied voltage exceeds a second predetermined voltage higher than the first predetermined voltage, and automatically restart the tool after it is shut off when the voltage reaches a third predetermined voltage lower than the second predetermined level.

18. The non-explosive system of claim 17, wherein the electronic controller is a printed circuit board.

19. The non-explosive system of claim 17, wherein the first predetermined voltage is set at about 10 V de at a head of the tool lower than the second predetermined voltage.

20. The non-explosive system of claim 19, wherein the second predetermined voltage is set about 260 V de at a head of the tool, and the third predetermined voltage is set at about 230 V de at the head of the tool.

21. A method for setting an auxiliary down hole tool using a non-explosive setting tool and resetting the setting tool, the setting tool having a tool body with a longitudinal bore and proximal and distal ends, the method comprising the following steps:

maintaining hydraulic fluid in a hydraulic fluid reservoir in the tool body at a first predetermined pressure by using pressurized gas in a first gas source to apply a first force against the hydraulic fluid;

maintaining the gas in a second gas source at a second predetermined pressure greater than the first predetermined pressure to apply a second force against the distal side of a setting piston movable in the longitudinal bore of the setting tool;

pumping the hydraulic fluid from the hydraulic fluid reservoir to apply a third force against a proximal side of the setting piston, the third force being great enough to overcome the second force and move the setting piston from a starting position toward the distal end of the setting tool;

blocking a hydraulic fluid return passageway between the proximal side of the setting piston and the hydraulic fluid reservoir with a reset valve to prevent the hydraulic fluid from flowing through the hydraulic fluid return passageway and an open position allowing the hydraulic fluid to flow through the fluid return passageway when the setting piston is moving toward the distal end of the setting tool; and opening the hydraulic fluid return passageway with the reset valve so that the second predetermined pressure in the second gas source can overcome the first predetermined pressure in the hydraulic fluid reservoir and move the setting piston back to the starting position.

22. The method of claim 21, further comprising providing an electronic controller that is programmed to run the tool at a first predetermined voltage, automatically shut off the tool when applied voltage exceeds a second predetermined voltage higher than the first predetermined voltage, and automatically restart the tool after it is shut off when the voltage reaches a third predetermined voltage lower than the second predetermined level.

23. The method of claim 22, wherein the electronic controller is a printed circuit board.

24. The method of claim 22, wherein the first predetermined voltage is set at about 10 V de at a head of the tool lower than the second predetermined voltage.

25. The method of claim 22, wherein the second predetermined voltage is set about 260 V de at a head of the tool, and the third predetermined voltage is set at about 230 V de at the head of the tool.

26. A method for regulating the voltage of a non-explosive setting tool of the type that comprises a tool body with a longitudinal bore and distal and proximal ends, a setting piston movable in the longitudinal bore, a fluid reservoir for supplying hydraulic fluid to move the piston toward the distal end, a hydraulic motor for pumping the hydraulic fluid, a voltage regulator that shuts off the tool when voltage in the tool reaches a first predetermined level and restarts the tool when the voltage in the tool reaches a second predetermined level lower than the first predetermined level, and a source of resistance against the piston moving toward the distal end until fluid from the reservoir can provide a sufficient force to overcome the resistance, the method comprising the following steps:

running the tool at a first predetermined voltage;

automatically shutting off the tool when the voltage exceeds a second predetermined voltage higher than the first predetermined voltage; and automatically restarting the tool after it is shut off when the voltage reaches a third predetermined voltage lower than the second predetermined voltage.

27. The method of claim 26, wherein the first predetermined voltage is set at about 10 V de at a head of the tool lower than the second predetermined voltage.

28. The method of claim 26, wherein the second predetermined voltage is set about 260 V de at a head of the tool, and the third predetermined voltage is set at about 230 V de at the head of the tool.

* * * * *